United States Patent [19]

Peters et al.

[11] 3,949,857

[45] Apr. 13, 1976

[54] ELECTROMECHANICAL WRITING DEVICE

[75] Inventors: Hinderikus Peters, Paderborn; Reinhard Mix, Salzkotten, both of Germany

[73] Assignee: Nixdorf Computer AG, Paderborn, Germany

[22] Filed: Aug. 28, 1974

[21] Appl. No.: 501,283

[30] Foreign Application Priority Data

Aug. 30, 1973 Germany ..... 2343859

[52] U.S. Cl. ..... 197/186 A

[51] Int. Cl.[2] ..... B41J 29/02

[58] Field of Search ..... 197/186 R, 186 A, 186 B, 197/19, 9 B, 9, 12, 13, 14, 6.1, 1 R

[56] References Cited

UNITED STATES PATENTS

| | | | |
|---|---|---|---|
| 1,383,638 | 7/1921 | Kidder | 197/186 A |
| 1,410,764 | 3/1922 | Latta | 197/186 R |
| 3,001,631 | 9/1961 | Fresard | 197/186 A |
| 3,732,965 | 5/1973 | Mero | 197/186 A |
| 3,830,352 | 8/1974 | Kolpek | 197/186 A |

*Primary Examiner*—Edgar S. Burr
*Assistant Examiner*—R. T. Rader
*Attorney, Agent, or Firm*—Gifford, Chandler & Sheridan

[57] ABSTRACT

An electromechanical writing device comprising a writing head, a carrier for carrying the writing head, a guide bar along which the carrier is movable during a writing operation, a writing platen disposed parallel to the direction of movement of the carrier, an upper frame part on which the guide bar is mounted, a lower frame part, and a pivot axis about which the upper frame part and the lower frame part are mounted for pivotal movement relative to one another. The pivot axis is disposed parallel to the length of the writing platen which itself is disposed in a plane which bisects an imaginary cylinder coaxial with the pivot axis. An adjustable stop is provided for adjusting the distance between the writing head and the writing platen and the position of closest approach of the upper frame part and the lower frame part.

8 Claims, 5 Drawing Figures

ELECTROMECHANICAL WRITING DEVICE

BACKGROUND OF THE INVENTION

I. Field of the Invention

This invention relates to electromechanical writing devices.

II. Prior Art

Known electromechanical writing devices may have a plurality of connecting bars provided between two outer side plates to form a rigid frame in which a writing head is moved on a carrier so as to traverse past a recording paper and during this movement to perform a writing operation. The writing head may be in the form of a mosaic printer, for example, and be energized by electric signals supplied thereto via a multi-core cable.

General prerequisites for electromechanical writing devices are simplicity of design and ease of maintenance. To this end, the individual components of the writing device, and especially the sensitive writing head, must be easily accessible and yet, on the other hand, the writing device must be compact as a whole. Moreover, it must be possible to carry out any maintenance work required without involving difficult dismantling of components of the writing device.

According to the present invention there is provided an electromechanical writing device comprising a writing head, carrier means for carrying the writing head, guide means along which the carrier means is movable during a writing operation, a writing platen disposed parallel to the direction of movement of the carrier means, an upper frame part on which the guide means is mounted, a lower frame part, a pivot axis about which the upper frame part and the lower frame part are mounted for pivotal movement relative to one another, the pivot axis being disposed parallel to the length of the writing platen which is disposed in a plane which bisects an imaginary cylinder coaxial with the pivot axis, an adjustable stop means for adjusting the distance between the writing head and the writing platen and the position of closest approach of the upper frame part and the lower frame part.

This construction makes it possible to build an electromechanical writing device in a very simple manner and yet, at the same time, to increase the precision of adjustment of the distance between the writing head and the writing platen.

The pivot axis may constitute a cross bar forming part of the upper frame part, the cross bar being disposed in recesses in the lower frame part. This makes it possible to remove the upper frame part and the lower frame part, during or after the pivotal movement of the upper frame part relative to the lower frame part, so that the writing device is then in two halves, each being perfectly accessible, for example, for maintenance.

Preferably each said recess has a depth which is at least twice the diameter of the cross bar, the longitudinal sides of each recess being disposed parallel to the said plane which bisects said imaginary cylinder. This ensures that the cross bar can only be removed from the recesses in a predetermined position of the upper frame part relative to the lower frame part so that the upper frame part is removed from the lower frame part in a direction in which damage to sensitive components, such as the writing head, is reduced or prevented.

The cross bar may be provided with sleeve elements, each of which has a flat surface, one sleeve element being disposed partially in each recess, retaining means being provided on a lower frame part for engaging the sleeve elements and preventing removal of the cross bar from the recesses, the arrangement being such that, when the upper frame part and the lower frame part are in a predetermined relative position, the flat surfaces of the sleeve elements are so disposed relative to the retaining means that the cross bar may be removed from the recesses.

The writing device preferably includes a locking mechanism for preventing pivotal movement of the upper frame part and the lower frame part relative to one another, and release means for releasing the locking mechanism to permit said pivotal movement of the upper frame part relative to the lower frame part. The locking mechanism may comprise a lever which is pivotally mounted on the upper frame part and is provided with a jaw which engages in abutment on the lower frame part to prevent said pivotal movement of the upper frame part relative to the lower frame part.

Said lever may carry a locking pin which is urged by spring means into a bore in the upper frame part and which is moved out of the bore to allow the upper frame part to pivot relative to the lower frame part by the release means which are mounted on the carrier means. A resilient stop mechanism may be disposed on the upper frame part for determining a rest position of the carrier means, movement of the carrier means against the action of the resilient stop mechanism causing the release means to release the locking mechanism.

BRIEF DESCRIPTION OF THE DRAWINGS

The invention is illustrated, merely by way of example, in the accompanying drawings, in which.

DETAILED DESCRIPTION

Figure 1:
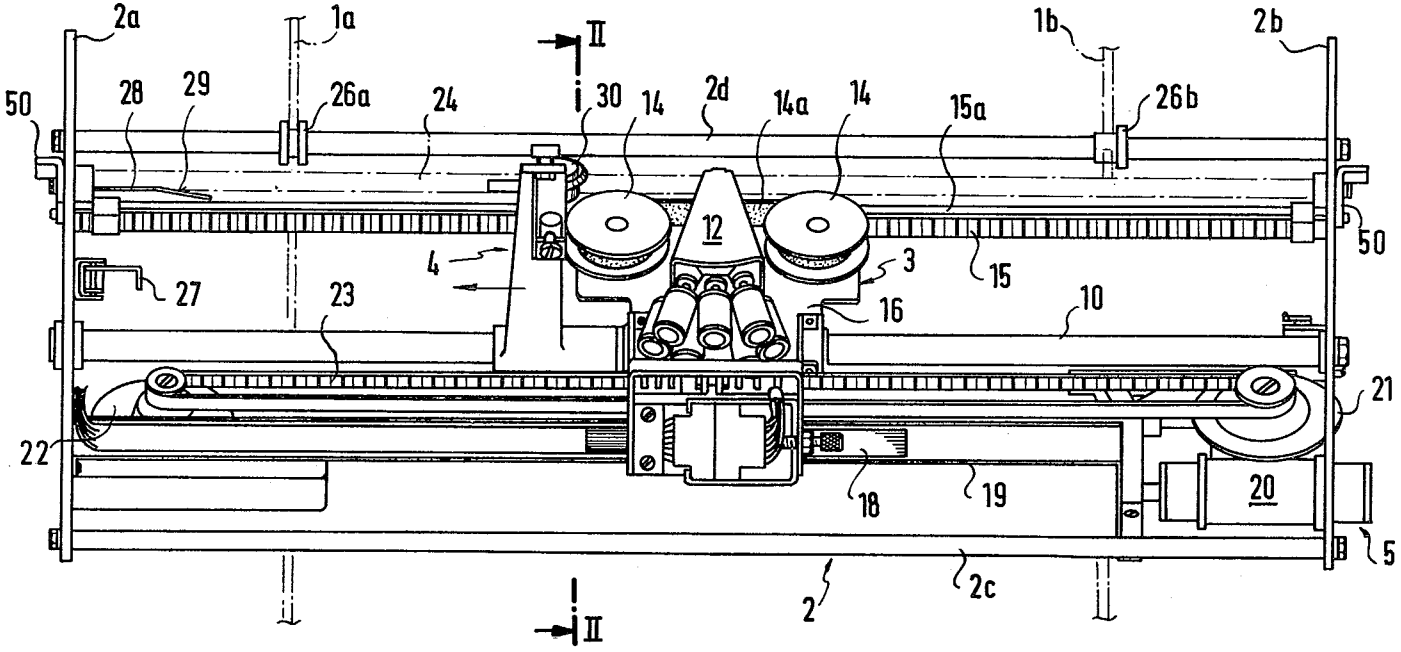
FIG. 1 is a plan view of an electromechanical writing device according to the present invention.

In the following description, the terms "left", "right". "upper", "lower", etc. refer to the directions as seen in the drawings.

Referring first to FIG. 1, there is shown an electromechanical writing device according to the present invention. A frame consists of an upper frame part 2, of a lower frame part 1, which is shown in phantom lines in FIG. 1. The lower frame part 1 has two side plates 1*a*, 1*b*, and the upper frame part has two side plates 2*a*, 2*b*. The side plates 2*a*, 2*b* are connected to one another by cross bars 2*c*, 2*d*, 15*a* and a guide bar 10, thus forming a rigid unit. A writing platen 24 is mounted on the lower frame part 1.

A writing mechanism 3 is guided on the guide bar 10 which, as mentioned above, forms part of the upper frame part 2. The writing mechanism part 3 comprises a carrier 16, two spools 14 carrying an inked ribbon 14*a* therebetween, and a writing head 12, which is in the form of a mosaic printer. The writing head 12 is controlled by electric signals fed thereto via a multi-core cable 18, which is laid in a duct 19 and which, while the writing mechanism 3 moves along the guide bar 10, is carried along by the corresponding formation of loops in the duct 19. The writing mechanism 3 is moved along the guide bar 10 by a drive 5 consisting of an electric motor 20, a driven disc or pulley 21, a toothed belt 23 and a guide pulley 22.

Figure 4:
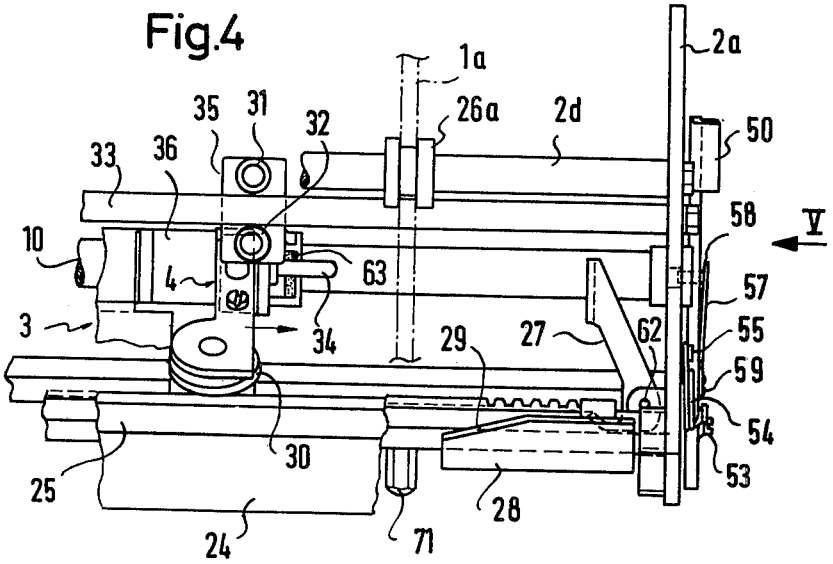
FIG. 4 shows a locking mechanism of the writing device of FIG. 1.

Disposed on the guide bar 10, adjacent to the writing mechanism 3, there is a cutting device 4 for which, as it is moved along the guide bar 10 can cut a recording medium (not shown), e.g. paper, by virtue of cooperation between the writing platen 24 and a roller knife 30 of the cutting device. The roller knife 30 is mounted on a roller knife carrier 35 and is guided on a bar 33 (see FIGS. 2, 4, 5 having a square cross section) by means of ball bearings 31, 32 (FIG. 4).

The upper frame part 2 is capable of pivotal movement relative to the lower frame part 1 about the cross bar 2*d* which defines a pivot axis. The plane of the platen 24 is arranged to bisect an imaginary cylinder coaxial with the cross bar 2*d*. The cross bar 2*d* is mounted in bushings 26*a*, 26*b* disposed in recesses in the side plates 1*a*, 1*b* of the lower frame part 1. To permit the upper frame part 2 to pivot out of the plane of FIG. 1 relative to the lower frame part 1, it is first necessary to release a locking lever 50 on each of side plates 2*a*, 2*b*.

Figure 2:
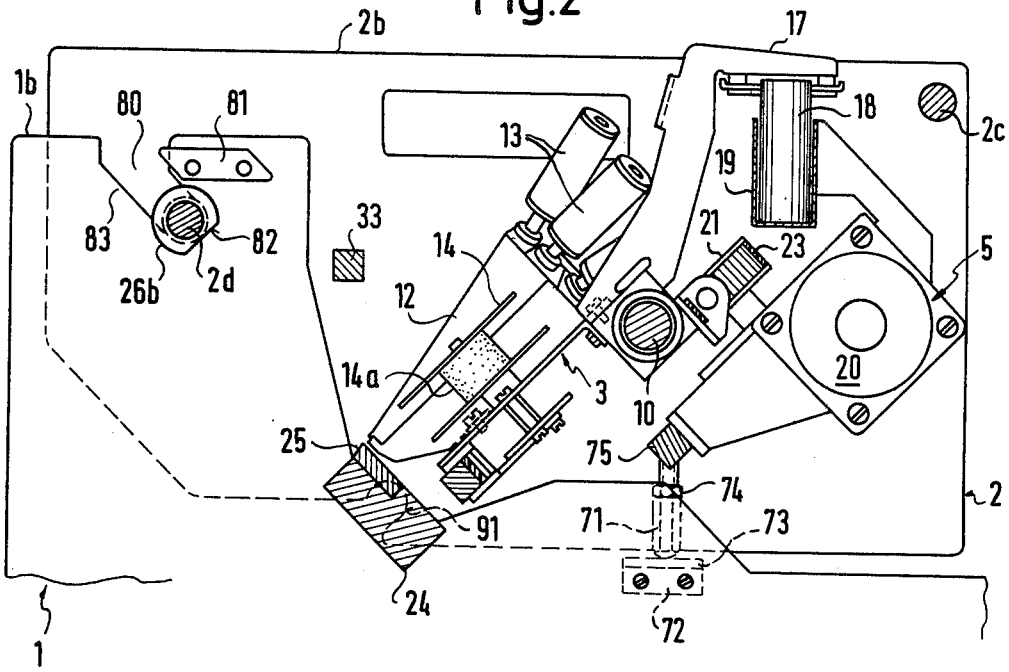
FIG. 2 is a section of the writing device shown in FIG. 1 taken along the line II-II.

The cooperation between the writing platen 24 and the cross bar 2d is shown most clearly in FIG. 2. The writing platen 24, which is straight, is fixed to the lower frame part 1 in a manner which is not illustrated. The writing platen is provided with a straight cutting edge 25. The cutting edge is ground on the side which cooperates with the roller knife 30 in such a way as to form a shearing edge past which the cutting edge of the roller knife 30 moves when the latter performs a cutting operation on a recording medium which is guided over the writing platen 24. The arrangement of the roller knife 30 and the cutting edge 25 is such that the cutting operation cuts the recording medium in a direction which is parallel to the directions of lines of writing produced by the writing head 12 during the writing operation. The writing head 12 has a plurality of electromagnets 13 which operate individual stylii. These stylii are arranged to act on the writing platen 24 in the direction of right angles to the cutting edge 25. It can also be seen from FIG. 2 how the multi-core cable 18 is carried along the guide bar 10 in its duct 19 by way of a support 17 during movement of the writing mechanism 3.

The cross bar 2d, as shown in FIG. 2, is associated with the side plate 1*b* of the lower frame part 1. A recess 80 is formed in a side plate 1*b*, the longitudinal sides of the recess 80 extending in a direction parallel to the plane of the writing platen 24. Thus the cross bar 2*d* can only be removed from the side plate 1*b* by moving it in a predetermined direction. The recess 80 has a depth which is at least twice the diameter of the cross bar 2*d*. A locking bar 81 is mounted on a side plate 1b to prevent accidental removal of the cross bar 2*d* from the recess 80 by restricting movement of the sleeve 26*b* of the cross bar 2*d* out of the recess 80. Since, however, the sleeve 26*b* is provided with a flat face 82, the cross bar 2*d* can be removed from the lower frame part 1 in a predetermined position of the upper frame part 2 relative to the lower frame part 1. This predetermined position is where the upper frame part 2 and the lower frame part 1 are pivoted relative to one another to 90° in the counterclockwise direction from a position of closest approach as shown in FIG. 2. This ensures that the upper frame part 2 can be removed from the lower frame part 1 when all parts of the writing device sensitive to damage are far enough away from parts of the lower frame part 1 for there to be no risk of their being damaged when the upper frame part 2 is moved away from the lower frame part 1.

Since a recess 80 is also provided in a side plate 1*a* (not shown in FIG. 2) of the lower frame part 1 and extends in a direction parallel to the plane of the writing platen 24, the sleeves 26*a*, 26*b* of the cross bar 2*d* are pressed against edges 83 of the recesses 80 by virtue of the weight of the upper frame part 2. This ensures, moreover, that by virtue of the engagement of the cross bar 2*d* in the recesses 80, the correct spacing is always obtained between the writing head 12 and the writing platen 24.

Precise adjustment of the distance between the writing head 12 and the writing platen 24 is achieved by means of two set screws 71, only one of which is shown in FIG. 2. These set screws 71 are provided with respective lock nuts 74 by means of which they are fixed relative to a connecting bar 75 having a square cross section and extending between the side plates 2*a*, 2*b*. The set screws 71 abut respective stops 73 provided on angle pieces 72 fixed to the lower frame part 1. To adjust the distance between the writing head 12 and the writing platen 24, feeler gauges (not shown) are used and then the set screws 71 are adjusted so as to abut the respective stops 73. The adjustment of the set screws 71 is not particularly critical because, owing to its longer lever arm to the cross bar 2*d* by comparison with the disposition of the writing head 12, a relatively large rotation of the set screws produces only a relatively small change in the distance between the writing head 12 and the writing platen 24. Thus a high degree of precision is achieved in the adjustment of the position of the writing head relative to the platen.

Figure 3:
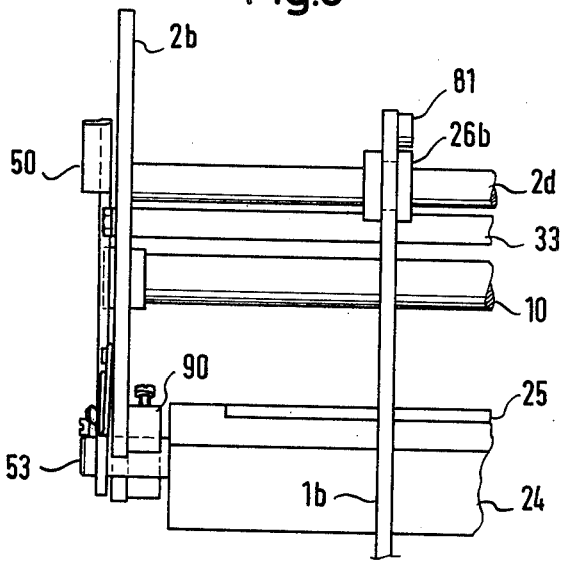
FIG. 3 is a front elevation of part of the writing device of FIG. 1.

As shown in FIG. 3, the writing platen 24 permits relatively simple positioning of the upper frame part 2 relative to the lower frame part 1. To this end the writing platen 24 is provided at both ends with positioning pins 53 which rest in respective recesses in the side plates 2*a*, 2*b*. In FIG. 3 the side plate 2*b* is shown enclosed in the positioning pin 53. Also fixed to the side plate 2*b* is a positioning block 90 which, when the upper frame part 2 is placed on the lower frame part 1, is pushed into contact with the positioning pin 53 to which end the positioning block 90 has a U-shaped cut out therein. A similar positioning block is fixed to the side plate 2*a* but is not shown in FIG. 3. The position of the line of writing to be written during a writing operation, that is to say the position of the writing platen 24 relative to the writing head 12, is defined by recesses 91 (FIG. 2) and the side plates 2*a*, 2*b* being brought, by virtue of the weight of the upper frame part 2, against the positioning pins 53 of the writing platen 24. In this way the writing platen 24 can be positioned very precisely and in a very simple manner in relation to the writing head 12.

FIG. 4 illustrates a locking mechanism which is associated with each of the side plates 2*a*, 2*b*. The release of the locking mechanism, which is situated on the outside of the side plate 2*a*, is effected by means of a pin 34 which is mounted on the cutting device 4. The cutting device 4 can be brought into a right hand rest position by movement in the direction of the arrow shown in FIG. 4. In this rest position a permanent magnet 63, fixed to the roller knife carrier 35, is brought into contact and engages a spring loaded lever 27 mounted on the side plate 2*a*. The cutting device 4 can then be put into operation from the rest position if it is mechanically coupled with the writing mechanism 3 and transported, together with the latter, along the guide bar 10. The roller knife 30 thereby performs a cutting operation by virtue of its operation with the cutting edge 25 on the writing platen 24.

The cutting device 4 can be taken beyond the rest position determined by the lever 27, by movement towards the side plate 2*a*, for example, manually, to achieve an extreme right hand position. The pin 34 then projects into a bore in the side plate 2*a* and pushes another pin 58 out of this bore. The pin 58 is fastened by rivets 59 to the locking lever 50 via a leaf spring 57. The locking lever 50 can then be brought into position such that the side plates 2*a*, 2*b* can be swung away from the positioning pins 53.

Figure 5:
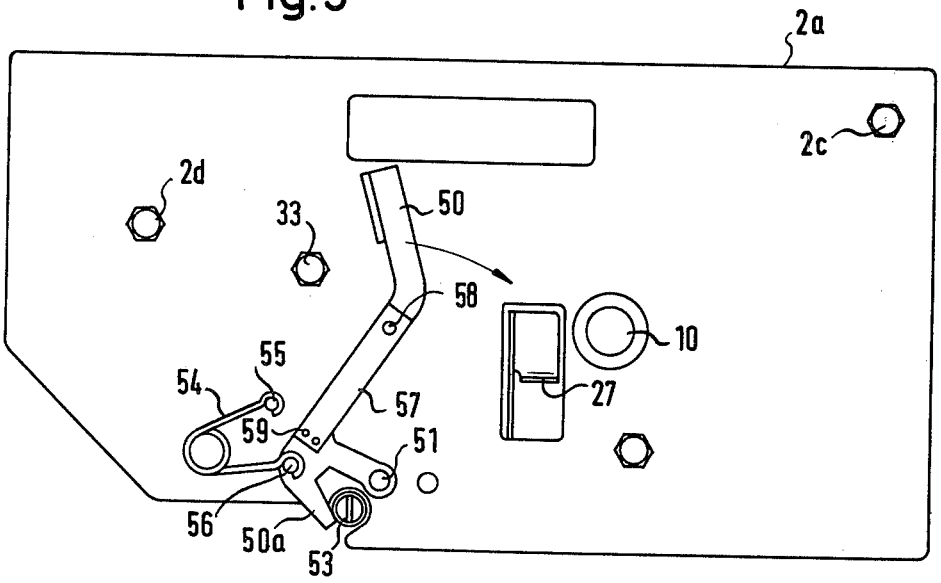
FIG. 5 is a side elevation of the locking mechanism of FIG. 4.

This locking mechanism is illustrated in detail in FIG. 5. It shows an outer side elevation of the side plate 2*a* and from it can be seen that the locking lever 50 is provided at its lower end with a jaw 50*a*, which, in the illustrated position of rest, surrounds the positioning pin 53 of the writing platen 24. The locking lever 50 is mounted for pivotal movement about a pin 51 fixed to the side plate 2*a* and, in the position shown, is held by a spring 54 which is fixed, on one side to a pin 55 on the side plate 2*a* and, on the other side, to a pin 56 on the locking lever 50. The leaf spring 57 is fixed to the longitudinal direction of the locking lever 50 and presses the pin 58 into the bore in the side plate 2*a*. When the pin 58 is pushed out of this bore by the pin 34 and the cutting device (FIG. 4), the locking lever 50 can pivot in the direction of the arrow shown in FIG. 5, whereby its jaw 50*a* releases the positioning pin 53 and the whole upper frame part 2 can then be pivoted away from the lower frame part 1. This ensures that the upper frame part 2 can pivot away from the lower frame part 1 if previously the cutting device 4 has been brought into its extreme right hand position shown in FIG. 4. At the same time the roller knife 30 is guided by roller elements (not shown) along an inclined surface 29 of a guide 28, so that in its rest position, it is spaced from the cutting edge 25 and cannot be damaged as the upper frame part 2 pivots towards the frame part 1 thereby permitting release of the locking mechanism. Likewise the roller knife will not be damaged during adjustment of the writing head relative to the writing platen.

Naturally a locking mechanism of the above described type can also be associated with the side plate 2*b* for which purpose a pin, similar to the pin 34, must be fixed to the carrier 16 of the writing mechanism 3.

What is claimed is:

1. An electromechanical writing device comprising:

a writing head;

carrier means for carrying the writing head;

guide means along which the carrier means is movable during a writing operation;

a writing platen disposed parallel to the direction of movement of the carrier means;

an upper frame part on which the guide means is mounted;

a lower frame part on which the writing platen is mounted;

a crossbar about which the upper frame part and the lower frame part are mounted for pivotal movement relative to one another, said crossbar being disposed parallel to the length of the writing platen so that the longitudinal axis of said crossbar lies in the plane of the writing platen; and adjustable stop means for adjusting the distance between the upper frame part and the lower frame part.

2. A writing device as defined in claim 1 in which the cross bar forms a portion of the upper frame part and is disposed in recesses in the lower frame part.

3. A writing device as defined in claim 2 in which each said recess has a depth which is at least twice the diameter of the cross bar, each longitudinal side of each recess being disposed parallel to the said plane of said writing platen.

4. A writing device as defined in claim 3 in which the cross bar is provided with sleeve elements each of which has a flat surface, one sleeve element being disposed partially in each recess, retaining means being provided on the lower frame part for engaging sleeve elements and preventing removal of the cross bar from the recesses, the arrangement being such that, when the upper frame part and the lower frame part are in a predetermined pivotal position relative to each other, the flat surfaces of the sleeve elements are so disposed relative to the retaining means that the cross bar may be removed from the recesses.

5. A writing device as defined in claim 1 including a locking mechanism for preventing pivotal movement of the upper frame part and the lower frame part relative to one another, and release means for releasing the locking mechanism to permit said pivotal movement of the upper frame part relative to the lower frame part.

6. A writing device as defined in claim 5 in which the locking mechanism comprises a lever which is pivotally mounted on the upper frame part and is provided with a jaw which engages the lower frame part to prevent said pivotal movement of the upper frame part relative to the lower frame part.

7. A writing device as defined in claim 6 in which said lever carries a locking pin which is urged by spring means into a bore in the upper frame part and which is moved out of the bore to allow the upper frame part to pivot relative to the lower frame part by the release means which are mounted on the carrier means.

8. A writing device as defined in claim 7 in which a resilient stop mechanism is disposed on the upper frame part and defines a rest position of the carrier means, and in which movement of the carrier means against the action of the resilient stop mechanism causes the release means to release the locking mechanism.

* * * * *